US010493777B1

(12) United States Patent
McConville et al.

(10) Patent No.: US 10,493,777 B1
(45) Date of Patent: Dec. 3, 2019

(54) ELECTRIC FIELD GENERATING TRANSPORT MEMBER

(71) Applicant: Xerox Corporation, Norwalk, CT (US)

(72) Inventors: Paul J. McConville, Webster, NY (US); Chu-heng Liu, Penfield, NY (US); Douglas K. Herrmann, Webster, NY (US); Seemit Praharaj, Webster, NY (US); Jason M. LeFevre, Penfield, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/050,323

(22) Filed: Jul. 31, 2018

(51) Int. Cl.

| | |
|---|---|
| ***B41J 13/02*** | (2006.01) |
| ***B41J 13/03*** | (2006.01) |
| ***B41J 13/10*** | (2006.01) |
| ***B41J 11/00*** | (2006.01) |

(52) U.S. Cl.
CPC ..... *B41J 11/002* (2013.01); *B41J 11/007* (2013.01); *B41J 13/02* (2013.01); *B41J 13/03* (2013.01); *B41J 13/10* (2013.01)

(58) Field of Classification Search
CPC .... B41J 13/00; B41J 13/0009; B41J 13/0027; B41J 13/0036; B41J 13/02; B41J 13/03; B41J 13/076
See application file for complete search history.

(56) References Cited

U.S. PATENT DOCUMENTS

| | | | | |
|---|---|---|---|---|
| 3,812,780 | A * | 5/1974 | Borelli | G03G 15/321 101/216 |
| 5,074,240 | A * | 12/1991 | Honma | G03B 27/32 118/625 |
| 5,771,054 | A | 6/1998 | Dudek et al. | |
| 7,216,968 | B2 | 5/2007 | Smith et al. | |
| 8,840,241 | B2 | 9/2014 | Fletcher et al. | |
| 2006/0164489 | A1 | 7/2006 | Vega et al. | |
| 2006/0164491 | A1 | 7/2006 | Sakuma et al. | |
| 2013/0279960 | A1 * | 10/2013 | Kobayashi | B41J 13/0009 399/381 |
| 2015/0036155 | A1 | 2/2015 | Priebe | |

FOREIGN PATENT DOCUMENTS

| | | | |
|---|---|---|---|
| EP | 0866381 | A1 | 9/1998 |

* cited by examiner

*Primary Examiner* — Scott A Richmond
(74) *Attorney, Agent, or Firm* — Fay Sharpe LLP

(57) ABSTRACT

A printer includes a printhead assembly which applies an ink composition to print media to form printed media. A dryer, downstream of the printhead assembly, at least partially dries the printed media. A transport mechanism conveys the printed media in a downstream direction between the printhead assembly and a dryer and between the dryer and an output device. The transport mechanism includes at least one electric field-generating transport member including a drive roller which is rotated about an axis of rotation to advance the print media in the downstream direction. The drive roller includes spaced electrical conductors, first portions of the electrical conductors being sequentially brought into proximity with the print media as the roller is rotated. A commutator is positioned to sequentially contact and apply a voltage to second portions of only a subset of the conductors that are in proximity with the print media.

13 Claims, 10 Drawing Sheets

ELECTRIC FIELD GENERATING TRANSPORT MEMBER

CROSS-REFERENCE TO RELATED APPLICATIONS

U.S. application Ser. No. 16/050,376, entitled ELECTRIC FIELD GENERATING TRANSPORT MEMBER, filed Jul. 31, 2018, by Paul M. Fromm, et al., is incorporated herein in its entirety, by reference.

BACKGROUND

The exemplary embodiment relates to transport devices for print media and finds particular application in connection with a transport member for an inkjet printing system which generates an electrostatic field or other electric field for transporting print media.

Inkjet printing systems generally include a printhead which applies a liquid ink composition from an array of inkjets to form an image on a sheet of print media, such as paper. Following deposition of the ink, the image is cured. Aqueous inks are often used which include a significant proportion of water and typically 5-15 weight % of cosolvents with boiling points above 200° C. The water is removed by drying the sheet with airflow and heat or infrared radiation, however, the cosolvents are best left to penetrate into the paper. When coated papers are used with aqueous ink, the cosolvent penetration rates are lower, due to reduced surface porosity. Glossy coated papers can be as low as 3% surface porosity.

Sheets of print media are conveyed through the printer by a sheet transport mechanism, which may include a combination of transport members, such as nip rollers, transport belts, and the like. Problems can occur in the transport mechanism, during drying, depending on the type of transport member used. In the case of nip rollers, these can damage the wet image through contact. Failure to fully dry the image before touching the rollers also causes roll contamination, requiring manual cleaning. Currently, aqueous inkjet systems are designed to dry the image to touch before engaging any nipped drive rollers. In the case of vacuum transport belts, which apply suction to the sheet from below, uneven heating of the sheet can occur. The effects of variation in heating rate and final achieved temperature are particularly noticeable in the image on coated media, which may be evident as a density shift or a gloss shift. Further, vacuum transports have a limited latitude to acquire and hold the sheet leading to the need to reduce the air flows in the dryer oven, especially while the first or last sheet enter or exit the dryer, when most of the transport vacuum holes are uncovered.

There remains a need for a sheet transport mechanism which facilitates drying of the sheets while minimizing these problems, and others.

INCORPORATION BY REFERENCE

The following references, the disclosures of which are incorporated herein by reference in their entireties, are mentioned.

U.S. Pat. No. 7,216,968, issued May 15, 2007, entitled MEDIA ELECTROSTATIC HOLD DOWN AND CONDUCTIVE HEATING ASSEMBLY, by Smith, et al., describes a media hold down and heating assembly of one embodiment of the invention is disclosed that includes a dielectric against which media is positioned, a conductive heating element, and an electrostatic hold down element. The conductive heating element is to conductively heat the media through the dielectric. The electrostatic hold down element is to electrostatically hold down the media against the dielectric.

U.S. Pat. No. 8,840,241, issued Sep. 23, 2014, entitled SYSTEM AND METHOD FOR ADJUSTING AN ELECTROSTATIC FIELD IN AN INKJET PRINTER, by Fletcher, et al., describes a system and method for adjusting an electrostatic field in a print zone of an inkjet printer. The printer includes an electrostatic tacking device to hold a sheet of recording media to a transport belt moving through the print zone for imaging with one or more inkjet printheads. A sensor determines the electrostatic field before the print zone and adjusts the electrostatic field with a corotron disposed after the tacking device and before the print zone. Reduction of the electrostatic field in the print zone can reduce imaging errors resulting from electrostatic fields.

U.S. Pat. No. 5,771,054, published Jun. 23, 1998, entitled HEATED DRUM FOR INK JET PRINTING, by Dudek, et al., describes an ink jet printing system which utilizes a heated rotary printing drum for mounting and carrying paper to be printed by one or more thermal ink jet printheads to achieve black or full color printing at high speed. Printing and drying are achieved prior to any transfer of the sheet from the drum, reducing smudging of images. Hold down of the sheet onto the drum can be achieved using vacuum or electrostatic forces to precisely retain the sheet on the drum until printing and drying are completed. Heating of the drum can be performed internally or externally.

U.S. Pub. No. 20060164491, published Jul. 27, 2006, entitled STABLY OPERABLE IMAGE-FORMING APPARATUS WITH IMPROVED PAPER CONVEYING AND EJECTING MECHANISM, by Sakuma, et al., describes an image-forming apparatus which includes an endless conveyor belt, a counter roller, and a clutch part. The endless conveyor belt is rotatable to convey paper with a surface of the conveyor belt being charged. The counter roller holds the paper between the conveyor belt and the counter roller and conveys the paper. The clutch part is caused to slip by the difference in velocity between the conveyor belt and the counter roller.

U.S. Pub. No. 20060164489, published Jul. 27, 2006, entitled LATENT INKJET PRINTING, TO AVOID DRYING AND LIQUID-LOADING PROBLEMS, AND PROVIDE SHARPER IMAGING, by Vega, et al., describes forming a charged latent image from ejected liquid on a transfer surface.

U.S. Pub. No. 20150036155, published Feb. 5, 2015, entitled CHARGER PROVIDING NON-UNIFORM ELECTROSTATIC HOLDING FORCE by Priebe, describes a printer transport belt having an electrically non-conducting surface. A charging subsystem is configured to add charge to the transport belt or to a transported sheet to provide an electrostatic holding force. An inking subsystem deposits a pattern of ink on the charged sheet. The charging subsystem provides a non-uniform charge on the sheet, enabling the sheet to expand as a result of ink being deposited by the inking subsystem.

EP Application No. EP0866381, published Sep. 23, 1998, entitled ELECTROSTATIC TRANSPORT SYSTEM FOR TONERED SHEETS, describes an electrostatic transport belt for transporting sheets.

BRIEF DESCRIPTION

In accordance with one aspect of the exemplary embodiment, a printer includes a printhead assembly which applies an ink composition to print media to form printed media. A dryer, downstream of the printhead assembly, at least partially dries the printed media. A transport mechanism conveys the printed media in a downstream direction between the printhead assembly and the dryer and between the dryer and an output device. The transport mechanism includes at least one electric field-generating transport member. Each of the at least one transport member includes a drive roller which is rotated about an axis of rotation to advance the print media in the downstream direction. The drive roller includes spaced electrical conductors. First portions of the electrical conductors are sequentially brought into proximity with the print media as the roller is rotated. A commutator sequentially contacts only a subset of the conductors that are in proximity with the print media. A charging unit applies a voltage to the commutator.

In accordance with another aspect of the exemplary embodiment, a method of printing includes applying an ink composition to print media to form wet printed media. The wet printed media is at least partially dried. At least one of the wet printed media and the at least partially dry printed media is conveyed with at least one electric field-generating transport member. Each of the at least one transport member includes a drive roller which is rotated about an axis of rotation to advance the print media in the downstream direction, the drive roller including spaced electrical conductors, first portions of the electrical conductors being sequentially brought into proximity with the print media as the roller is rotated. A commutator sequentially supplies a voltage to only a subset of the conductors that are in proximity with the print media.

In accordance with another aspect of the exemplary embodiment, an electric field-generating transport member for conveying a sheet without contacting an upper surface of the sheet is provided. The transport member includes a drive roller which is rotated about an axis of rotation, the drive roller including an insulating outer layer, a ground plane, and electrical conductors embedded in the insulating layer around a circumference of the roller. The insulating layer spaces the electrical conductors from each other and from the ground plane. Each of the electrical conductors includes a first portion and a second portion, the second portion being arcuately spaced from the first portion, the first portions extending parallel to the axis of rotation. A commutator sequentially applies a voltage to only a subset of the conductors through the respective second portions of the conductors, when the roller is rotated about the axis of rotation.

DETAILED DESCRIPTION

In accordance with one aspect of the exemplary embodiment, a field-generating transport member includes a drive roller employing electrostatics or varying electric fields to generate a frictional force needed to transport a sheet of paper. The field-generating transport member is suitable for use in aqueous inkjet systems and avoids the need for nipped drive rollers for transporting a sheet while the sheet is wet with ink.

As used herein, a "printer," or a "printing apparatus" refers to one or more devices used to generate printed media by forming images on print media, using a marking material, such as one or more colored inks or toner particles. The printer may be a digital copier, bookmaking machine, facsimile machine, multi-function machine, or the like, which performs a print outputting function. The print media may be sheets of paper, card, transparencies, parchment, film, fabric, plastic, photo-finishing papers, or other coated or non-coated flexible substrates suitable for printing. The system and method are particularly suited to printing coated sheets, which have lower porosity, and thus longer ink solvent absorption times, than uncoated sheets.

The printer includes a print engine which may incorporate one or more inkjet marking devices, each device including inkjet heads which jet droplets of ink onto the print media, which are then cured, e.g., with heat, air, ultraviolet radiation, or a combination thereof. Other marking devices are also contemplated.

The "process direction" refers to the direction in which a sheet travels along a paper path during the printing process. The "cross-process direction" refers to the direction perpendicular to the process direction, in the plane of the sheet.

While some components of the printer are described herein as modules, this is not intended to imply that they are separately housed from each other and in some embodiments, may be otherwise separated into different housings or contained in a single printer housing.

Figure 1:
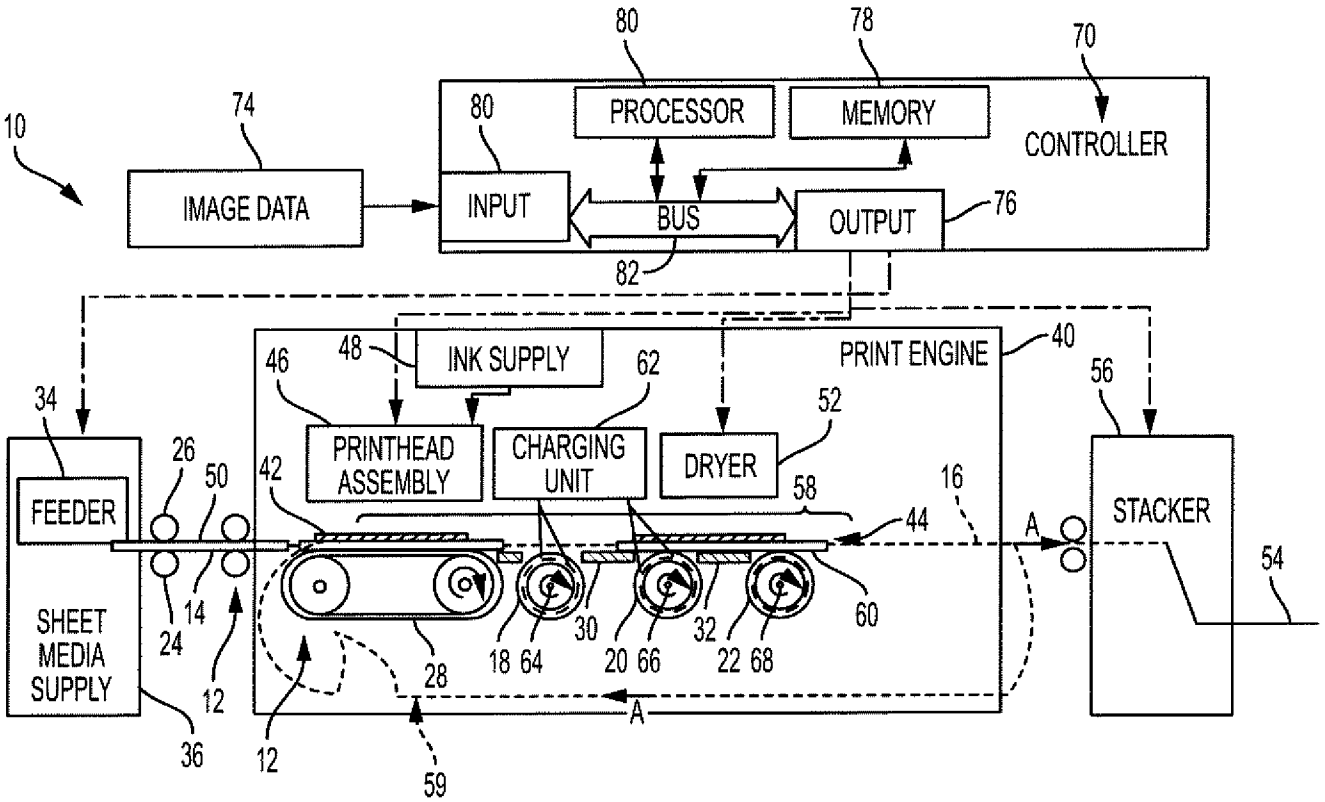
FIG. 1 is a schematic view of a printing apparatus including a sequence of transport members in accordance with one aspect of the exemplary embodiment.

With reference to FIG. 1, a printing apparatus 10, such as an inkjet printing apparatus, includes a sheet media transport mechanism 12 which transports sheets 14 of print media, such as paper, plastic, or card, in a downstream direction A along a paper path 16. The transport mechanism 12 includes one or more electric field-generating transport members 18, 20, 22, as further described below. The transport mechanism 12 may further include conventional transport members, such as drive rollers 24, idler rollers 26, conveyor belts 28, stationary baffles 30, 32 and/or other transport members. A sheet media feeder 34 feeds the sheets 14 singly from a sheet media supply 36 onto the paper path 16.

The transport mechanism 12 conveys the sheets 14 from the sheet media feeder 34 to a print engine 40, which applies an image 42 to each sheet, using a marking material, such as one or more inks, to form printed media 44. The illustrated print engine 40 includes a printhead assembly 46, which includes an array of inkjet nozzles that deposit droplets of one or more ink compositions 48 onto an upper surface 50 of the sheet 14. Each ink composition may be an aqueous ink composition which includes one or more colorants and water. The ink composition may alternatively or additionally include one or more non-aqueous solvents and/or radiation curable (i.e., polymerizable) monomers. For example, 5-15 wt. % of the ink may be non-aqueous solvents with boiling points above 200° C.

The printed sheet is conveyed directly from the printhead assembly 46 to a dryer 52, or other image fixing device (such as a UV curing station), where the wet image 42 is dried, cured and/or otherwise fixed more permanently to the sheet. The dryer 52 applies heat and/or other radiation, such as UV or IR radiation, and/or blowing air, to the printed sheets 44, e.g., from above the sheet. The dryer 52 includes a heat or other radiation source, such as an electric heater and/or light emitting diodes (LEDs), which is controlled to apply sufficient radiation to at least partially dry/cure the image 42. Non-aqueous solvents may remain on the sheet after drying. These co-solvents are allowed to penetrate the sheet while the sheet is transported downstream from the dryer.

In one embodiment, the paper and ink are heated with several infrared carbon lamps to at least 80° C., or at least 90° C. The drying process also removes moisture from the ink to prevent it from rubbing off. A combination of sensors, thermostats, thermistors, thermopiles, and blowers accurately heat the moving sheets to maintain a rated print speed. Since the time between the entry to the dryer and the first nip can be extended, as compared with a conventional transport mechanism, the present dryer 52 can operate at a lower temperature than in a conventional printing apparatus.

The printed sheet 44 is conveyed from the dryer 52, along the paper path 16, to a sheet output device 54, such as a tray, optionally via one or more additional components of the printing apparatus, such as one or more additional print engines, a sheet stacker 56, and/or other sheet processing components.

As used herein, the term "downstream direction" or "process direction" refers to movement along the paper path 16 towards the output device 54 and "cross-process direction" refers to a direction orthogonal to the process direction axis in the plane of the paper path 16.

The image 42 remains wet over a portion 58 of the paper path extending from the printhead assembly 46 to the dryer and in some cases, beyond the dryer, particularly in the case of solvent-containing ink compositions 48. In this path portion 58, the printed sheet 44 is conveyed by the field-generating transport member(s) 18, 20, 22. The transport members 18, 20, 22 contact only a lower surface 60 of the sheet, which is opposite to the recently-inked surface 50, In particular, one or more of the transport members 18, 20, 22 is positioned intermediate the printhead assembly 46 and the dryer 52 and/or one or more of the transport members 18, 20, 22 is positioned downstream of the dryer 52. The dried sheet may proceed to the output device 54 or may be returned to the print engine 40 for duplex printing, e.g., via return path 59 including an inverter.

Each field-generating transport member 18, 20, 22 applies an electrostatic field or varying electric field to the lower (generally non-inked) surface 60 of the sheet. The field creates a friction force between the sheet and the respective transport member 18, 20, 22, which allows each transport member to convey the sheet in a downstream direction, without the need to apply a physical force on the sheet from above. As is evident from FIG. 1, there are no nip rollers between the printhead assembly and the dryer for such purposes. One or more voltage sources 62 supplies electric charge to the field-generating transport members 18, 20, 22 for generating an electric field, e.g., by applying a fixed (DC) or alternating voltage.

Where two or more field-generating transport members 18, 20, 22 are arranged in sequence, as shown, a baffle 30, 32, such as a horizontal plate, may be positioned intermediate each of a pair of field-generating transport members 18, 20 and 20, 22, to support the sheet 14. Axial centers 64, 66, 68 of the field-generating transport members in each pair may be spaced by a distance which is less than a length of the sheet 14, in the process direction, such as about 20 cm apart, or less.

The operating components of the printing apparatus 10, such as media (sheet) feeder 30, printhead assembly 46, dryer 52, stacker 56, field-generating transport members 18, 20, 22, and other components of the media transport system 12, may be under the control of a controller 70. The controller includes an input device 72, which receives image data 74 for forming one or more images 42 on the sheet media 14, and an output device 76, which outputs control instructions to the operational components of the printing device. Memory 78 stores instructions for operating the printing apparatus, or various operational components thereof, and a processor device 80, in communication with the memory, executes the instructions. The hardware components 72, 76, 78, 80 of the controller 70 may be communicatively connected by a data/control bus 82. The controller 70 may cause the downstream field-generating transport member 20 in each pair of transport members to rotate at a higher speed than the upstream one(s) 18, to maintain tension on the printed sheet 44.

The printhead assembly 46 include printheads which eject the ink composition(s) onto the media sheets 14. In particular, the assembly 46 includes a supply 48 of ink, in liquid form. The controller 70 modulates the volume of the ink drops ejected by the printheads of the assembly 46 to form the selected image 42.

The image data 74 generally include information in electronic form that the controller 70 renders and uses to operate the inkjet ejectors in printheads in the printer to compensate for moisture in the ink and to form an ink image on the media sheets. These data can include text, graphics, pictures, and the like. The operation of producing images with colorants on print media, for example, graphics, text, photographs, and the like, is generally referred to herein as printing or marking. The printing apparatus 10 may be a drop-on-demand inkjet printer.

As will be appreciated, the printhead assembly 46 may include two or more inkjet printhead assemblies, each for a respective ink, such as C, M, Y, and K inks. In one embodiment, each printhead assembly may be associated with a respective dryer 52, in which case there may be a respective set of electrostatic transport members 18, 20, 22 for each printhead. In other embodiments, the sheets are not dried between printhead assemblies, and a common dryer 52 may be used. In this embodiment, electrostatic transport members 18, 20, 22 may be positioned, as needed to convey the wet sheets downstream to the dryer.

FIGS. 2-5 illustrate a transport member in accordance with a first aspect of the exemplary embodiment. With reference FIG. 2, a perspective view of one of the field-generating transport members 18 is shown. Each of the other transport members 20, 22 may be similarly configured. The transport member 18 includes a drive roller 86, which is driven around its central axis of rotation 64 in the direction of arrow B by a suitable drive mechanism, such as a motor 88. The motor may drive a drive shaft 90, e.g., through a connected drive belt 92. The drive shaft extends axially outward, from a first end 94 of the drive roller 86, and may extend through the roller to a second end 96 of the roller. The roller 86 may have a radius r of, for example, from 2-10 cm.

Figure 4:
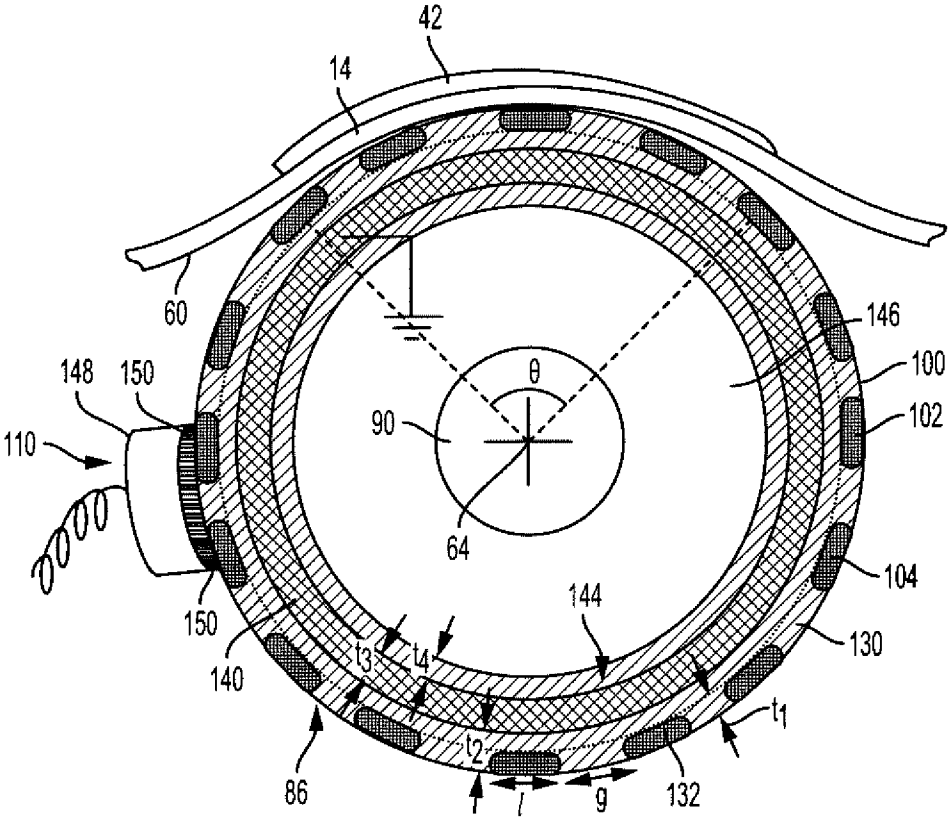
FIG. 4 is a side sectional view of the transport member of FIG. 2.

Embedded in a circumferential surface 100 of the roller 86 are multiple electrical conductors (bias electrodes) 102, 104, etc. The roller may include at least 6, or at least 8 or at least 10, or at least 16 arcuately-spaced electrical conductors 102, 104, etc., and in some embodiments, up to 100, or up to 80 of the electrical conductors. In a first region 106 of the roller 86, the electrical conductors 102, 104, extend in the cross-process direction and are spaced around the circumference 100 of the roller. The lower surface 60 of the sheet media contacts the drive roller 86 in a paper force zone 108 of the region 106. The paper force zone 108 has a width w corresponding to a width of the sheet, in the cross-process direction. The paper force zone 108 has a length l, along the outer surface 100 of the roller, corresponding to a small subset of the electrical conductors 102, 104, such as at least two or at least three conductors, or up to 10 or up to 5 conductors 102, 104. The paper force zone may define an arc of the roller circumference 100 which subtends an angle θ, at the center of the roller, of at least 15°, or at least 20°, or at least 30°, or up to 90°, or up to 70° (FIG. 4).

Figure 2:
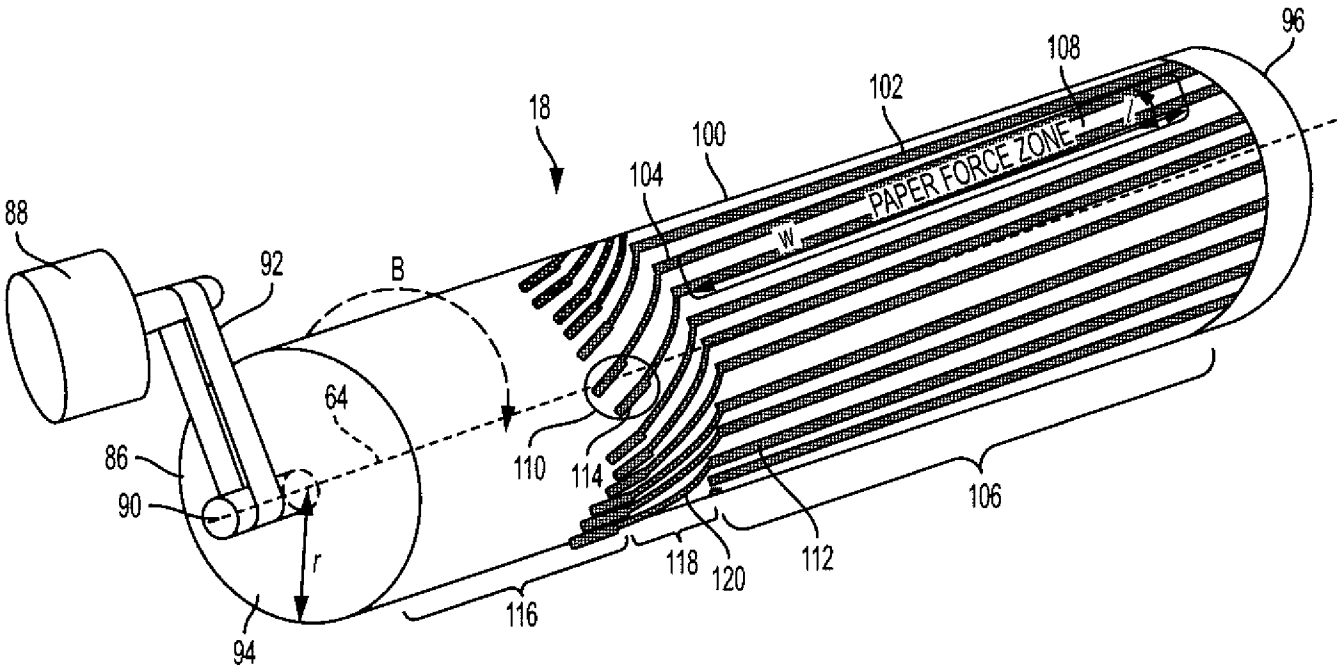
FIG. 2 is an enlarged perspective view of one of the transport members of FIG. 1.

As illustrated in FIG. 2, the electrical conductors 102, 104 may be arranged in parallel with each other and parallel to the roller axis 64 in the first region 106. Each electrode is thus arcuately spaced from its neighboring electrical conductors in region 106. At any one time, only a subset of the electrical conductors applies a field to the sheet in the paper force zone 108. For example the subset may include two to three of the electrical conductors such as conductor 104. A voltage is applied to these "contacting" conductors from the charging unit 62, e.g., through a commutator 110, such as a carbon brush, while neighboring conductors, outside the paper force zone, such as conductor 102, are not electrically charged. This causes an electrostatic force to be applied to the sheet in the paper force zone 108. The commutator 110 may be arcuately spaced, around the circumference of the roller 86, from the paper force zone 108, to avoid the commutator 110 making contact with the paper sheet 14. Accordingly, the conductors may 102, 104 may each include a first portion 112, in the first region 106 of the roller, and a second portion 114, in a second region 116 of the roller, the second portion of the electrode being arcuately spaced from the first portion 112, e.g., by at least about 20° and by up to 180°. The first and second regions 106, 116 of the roller are axially spaced from each other in the cross-process direction by an intermediate, third region 118. A third portion 120 of each electrode connects the first and second electrode portions 112, 114, e.g., by traversing a part of the circumference of the roller in third region 118. The commutator 110 thus contacts those of the conductor portions 114 in the third region 116 which are electrically connected to those of the conductor portions 112 currently encompassing the paper force zone.

Some or all of the conductors 102, 104 may be electrically connected to the voltage source 62.

An electric field generated by the conductors, when a voltage is applied, causes the sheet 14 to be attracted to the roller 86, but only in the narrow region of the paper force zone 108, where the conductors that are in contact with the commutator 110 at that time, are located. As the roller 86 is rotated, a new subset of the conductors enters the paper force zone 108 and provide the attractive force on the sheet. The conductors 102, 104, are thus sequentially charged as the roller rotates.

Figure 3:
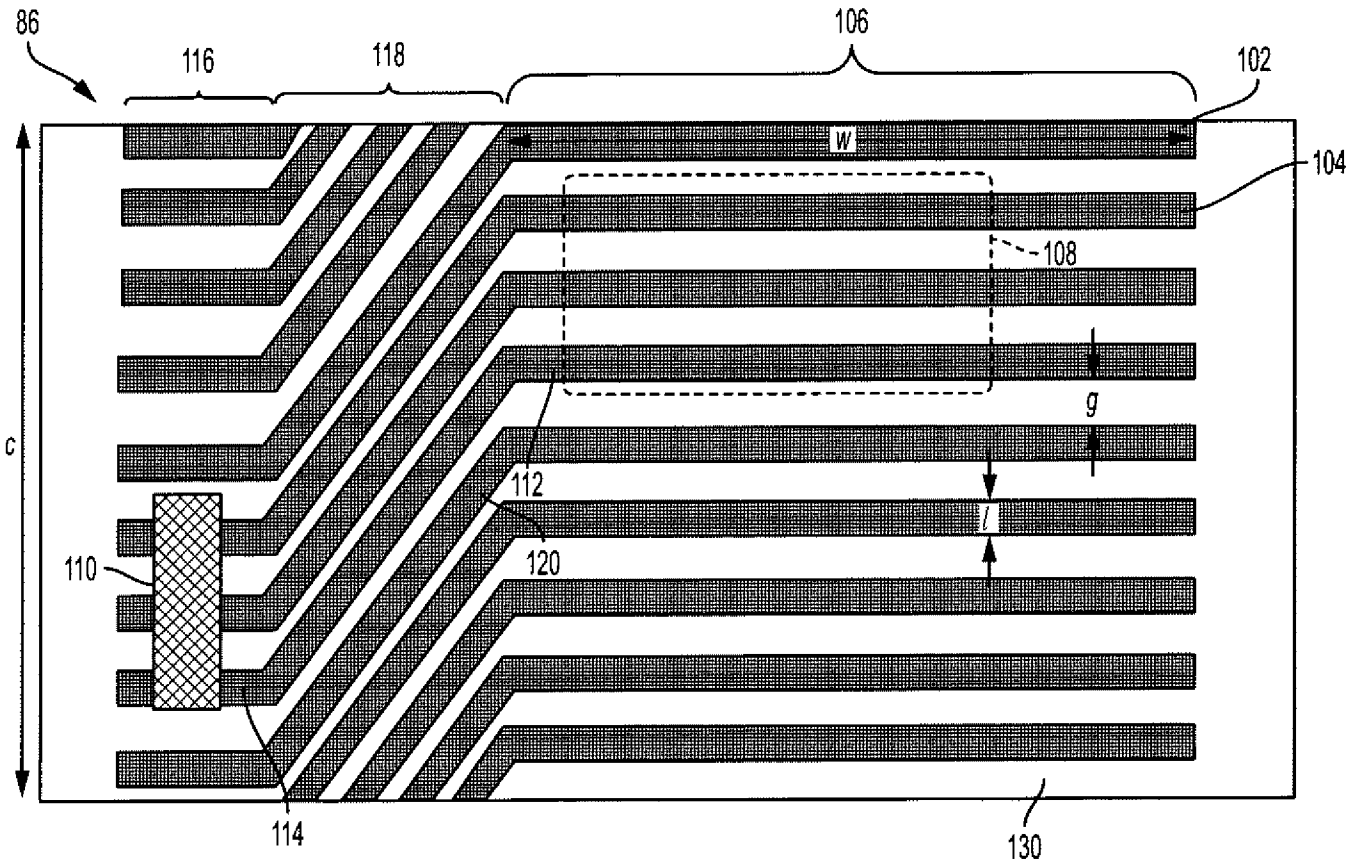
FIG. 3 is an unrolled view of an exterior of the transport member of FIG. 2.

FIG. 3 shows the outer surface of the roller 86 of FIG. 2 in plane view, as it would appear if unrolled. The circumference c of the roller may be, for example, from 1.5 cm-16 cm, such as at least 3 cm. Each conductor 102, 104 may have a length l (in the process direction) of, for example, from 0.5 to 4 mm, as measured along the circumference 100 of the roller. Each adjacent pair of conductors may be spaced by a gap of length g for example, at least 0.5 mm or at least 2 mm, or to 10 mm, such as about 5 mm, as measured along the circumference 100 of the roller. The gap is filled with electrically-insulating material. For a roller 86 having a diameter of, for example, from 2-3 cm, e.g., about 2.5 cm, there may be from 6 to 80 conductors, which are arcuately spaced around the circumference 100 of the roller.

The conductors 102, 104 may be at least predominantly formed of an electrically-conductive material. The electrically-conductive material may be a metal, such as copper, silver, or an alloy thereof. Certain carbon fibers and nanotube-based cables also have high conductivity, exceeding copper, which may be used. While the conductors 102, 104 are illustrated as thin strips, exposing a planar surface to the sheets, they may be rounded in cross section in some embodiments.

With reference also to FIG. 4, which shows a side view of the field-generating transport member 18 of FIG. 2, the roller 86 may include an outer-most layer 130 in which the conductors 102, 104, etc. are embedded. In the illustrative embodiment, an outer surface 132 of each of the conductors 102, 104 is exposed, i.e., forms a part of the outer surface 100 of the roller.

The outer layer 130 may be formed from an electrically-insulating material, i.e., a material which does not move charge given the bias voltage applied to the conductors 102, 104, etc.

Figure 5:
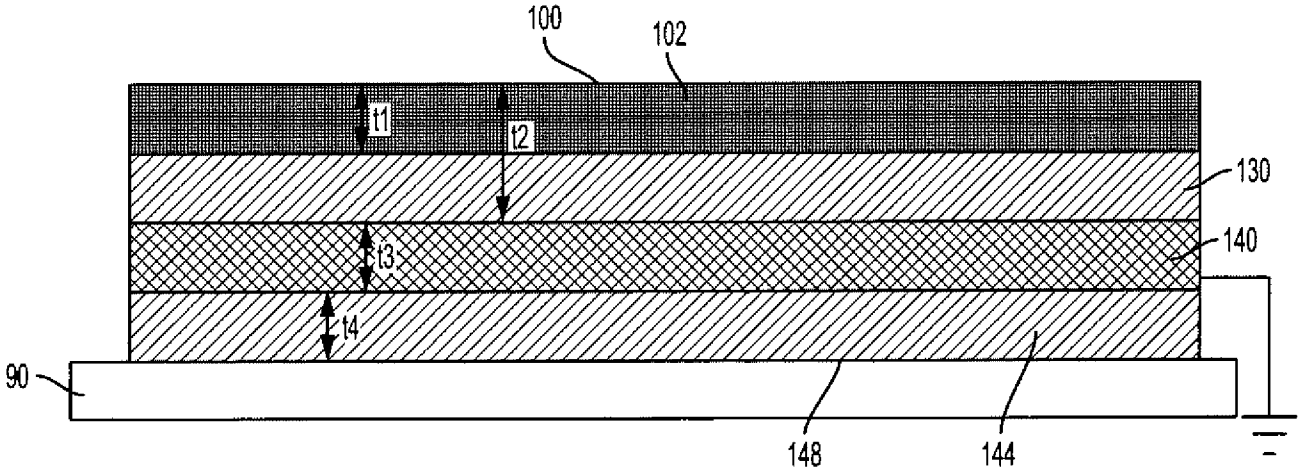
FIG. 5 is a cross-sectional view of the transport member of FIG. 4.

A radial thickness $t_1$ of the conductors 102, 104 may be at least 20 μm, or at least 40 μm, or at least 50 μm and may be up to 1 mm or up to 200 μm. The insulating outer layer 130 may have a radial thickness $t_2$ of at least 100 μm or at least 200 μm, or at least 1 mm, or up to 5 mm, where $t_2>t_1$, and thus extends inwardly of the conductors 102, 104. $t_2-t_1$ may be, for example, at least 1 atomic layer thick, such as at least 5 μm or at least 10 μm, or at least 20 μm, or at least 0.1 mm, or up to 4 mm, or up to 2 mm, or up to 1 mm, such as about 0.5 mm. In some embodiments, $t_2 \geq 1.5t_1$ or $t_2 \geq 2t_1$. The outer layer 130 of the roller axially spaces the conductors 102, 104 from an annular intermediate layer 140, which serves as a ground plane. The intermediate layer 140 is formed of an electrically-conductive material, such as copper. The layer 140 is connected to ground, e.g., through the axial shaft 90 of the roller. An annular inner electrically-insulating layer 144 contacts the intermediate layer 140. The intermediate layer 140 thus spaces the inner layer 144 from the outer electrically-insulating layer 130. The intermediate layer 140 may have an axial thickness $t_3$ of from 0.5-4 mm, for example, corresponding to the difference in radii between the outer circumference of the intermediate layer 140 and the inner circumference of the outer layer 130. The inner layer 144 may extend axially to the center shaft of the roller. The inner layer 144 may be formed from the same electrically-insulating material as the outer layer 130, or from another electrically-insulating material. The inner layer 144 may have an axial thickness $t_4$ of at least 0.5 mm, such as up to 10 mm or up to 4 mm, for example. As shown in FIG. 4, the roller 86 may include an inner support member 146, which spaces the inner layer 144 from the shaft. The inner support member 146 may be formed, for example, from metal, such as steel. Alternatively, the inner layer 144 may extend to the shaft, as illustrated in FIG. 5.

The outer layer 130 may have a low dielectric constant. The dielectric constant k is the relative permittivity of a material, relative to a vacuum (or air) and can be determined as the ratio of the capacitance induced by two metallic plates with an insulator between them to the capacitance of the same plates with air or a vacuum between them. As used herein, the dielectric constant k of an insulator is measured at 20° C. and 1 MHz, according to ASTM D150-11, "Standard Test Methods for AC Loss Characteristics and Permittivity (Dielectric Constant) of Solid Electrical Insulation," ASTM International, West Conshohocken, Pa., 2011.

The dielectric constant depends on the thickness of the material. Suitable insulting materials for use as the outer layer 130 of the roller have a dielectric constant k of up to 2, or up to 1.5, or up to 1, at the thickness employed. For example, the layer 130 may comprise or consist of polyethylene terephthalate (PET), which is available under the trade name Mylar®, or a polyimide, which is available under the trade name Kapton®. By employing a layer 130 which has a low thickness (e.g., when $t_2-t_1$ is less than 0.5 mm, or less than 0.1 mm), the dielectric constant can be reduced. Other examples of low dielectric insulators useful in extremely thin layers (e.g., $t_2-t_1$ is less than 0.2 mm, or less than 1 mm) include metal oxides.

The conductors 102, 104, and layers 130, 140, 144 may be bonded together. This may be achieved, for example, by building the roller 86 in layers. The inner parts (core 90 and layer 146) may be assembled and then dip-coated or otherwise coated with an insulative material for forming layer 144. Layer 144 may be solidified by drying and/or curing. The ground plane 140 may be formed by depositing conductive material on the layer 144, e.g., by vacuum deposition. The inner part of layer 130 may then be formed by dip-coating the assembly with a thin layer of insulative material to a depth of $t_2-t_1$, which may be dried or cured. Electrodes 102, 104 are formed by depositing conductive material on the partial layer 130, e.g., by vacuum deposition, and patterning to create gaps between conductors. Other methods for forming conductors include printing, such as screen-offset printing. Further insulative material is then applied to fill the gaps between the conductors.

As shown in FIG. 4, the commutator 110 may include an electrically-conductive block 148 which supports a number of electrically-conductive bristles 150. The bristles contact the outer surface 100 of the roller, including the conductor portions 114, as they rotate past the commutator. This supplies a charge to be applied to corresponding conductor portions 112. The block 148 is electrically connected with the charging unit 62, which may be set to apply a high voltage between the conductors currently contacted by the bristles and the ground plane 140. For example, the charging unit 62 may apply a DC voltage of at least 500V or at least 1000V. An electric field is generated between the conductor portions 112 and the ground plane 140, which causes the sheet 14 to be drawn into contact with the corresponding portions 112 of the conductors. In accordance with one aspect of the exemplary embodiment, a field-generating transport member includes a continuous belt employing electrostatics or varying electric fields to generate a frictional force needed to transport a sheet of paper. The field-generating transport member is suitable for use in aqueous inkjet systems and avoids the need for nipped drive rollers for transporting a sheet while the sheet is wet with ink.

Alternatively, the commutator may include the block 148, without bristles. In this case, the block 148 may have an arcuate surface with a radius of curvature which matches that of the roller 86 to provide electrical contact between the commutator block 148 and the subset of conductors adjacent thereto. A biasing member, such as a spring, may bias the commutator 110 into contact with the roller surface.

The electric field generated when the voltage is applied may be at least 0.1 or at least 0.2 V/μm at the paper. In the embodiment of FIG. 4, this can be determined from the fields associated with the electric dipole formed by electrode 102 against the ground plane 140. In some embodiments, this may be estimated from the applied voltage divided by the distance between the conductors (gap g). For example, for a gap of 5 mm and an applied voltage of 1300V, the electric field is 0.26V/μm.

As the drive roller is rotated, the first portions 112 of the electrical conductors are sequentially brought into proximity with the sheet 14 in the force zone 108 and the commutator 110 sequentially contacts the second portions 114 of the conductors thereby applying the voltage only to those of conductors whose first portions are proximate the sheet.

Figure 6:
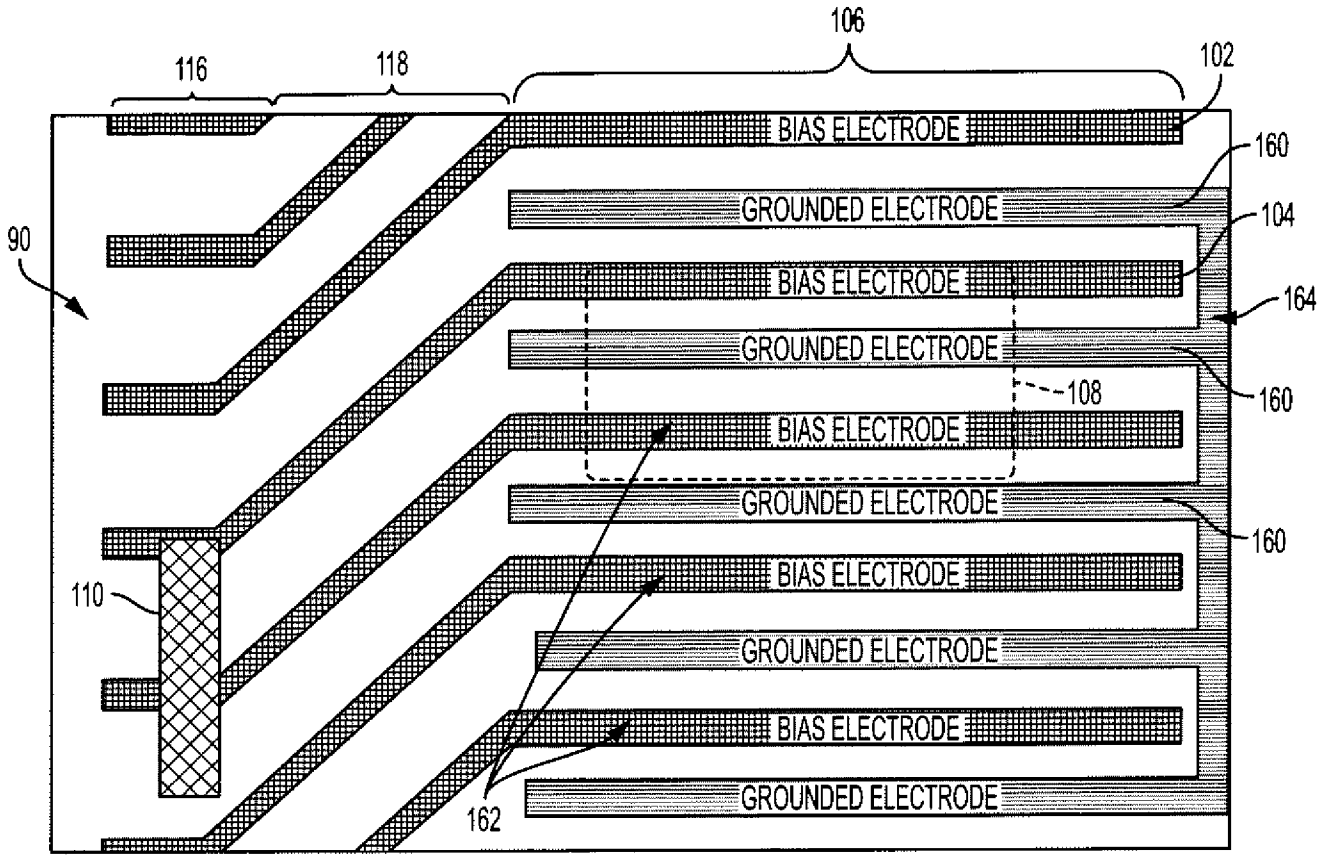
FIG. 6 is an unrolled view of an exterior of a transport member in accordance with another aspect of the exemplary embodiment.
Figure 7:
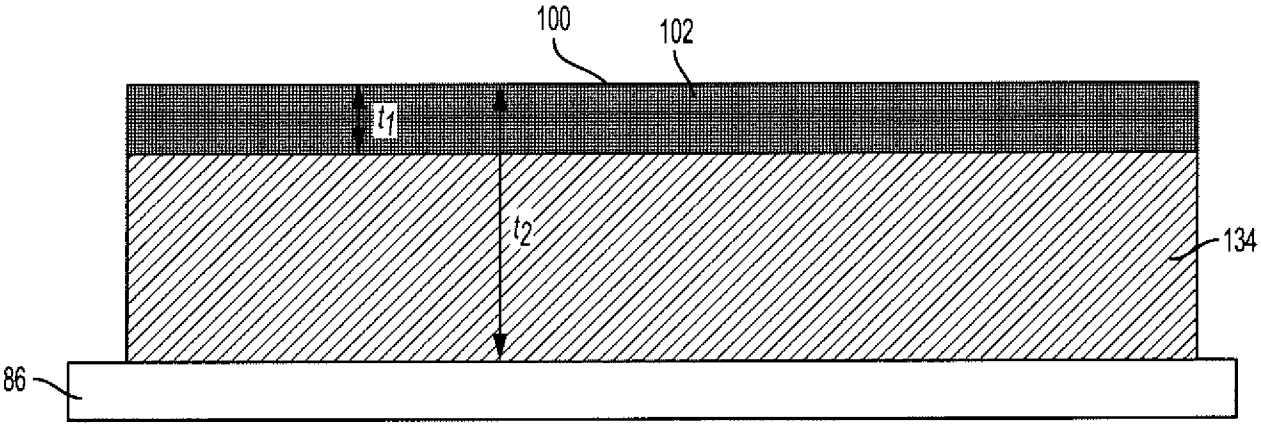
FIG. 7 is a side sectional view of part of the transport member of FIG. 6.

FIGS. 6 and 7 illustrate another embodiment of a roller 86. FIG. 6 shows the roller in an unrolled, plan view. In this embodiment, sets 160, 162 of conductors are interdigitated and lie in parallel to each other in the first region 106 of the roller. In this embodiment, the first set of conductors 102, 104, is configured as for the conductors of FIGS. 2-5, while the second set 162 of conductors is connected to ground, e.g., through an annular conductor 164. As illustrated in FIG. 7, this embodiment obviates the need for a ground plane layer 140 and intermediate layer 130 (FIG. 5). In this embodiment, layer 134 may have a thickness $t_2$ which corresponds to the total of $t_2+t_3+t_4$ in the embodiment of FIGS. 2-5. In other respects, the roller 86 of FIGS. 6 and 7 may be similarly configured to that of FIGS. 2-5.

One advantage the present apparatus and method is that printed pages are transported without impacting the image of a print which is not yet fully dried. Conveyor belts, which use vacuum force to hold the wet sheet down are not needed, resulting in more even drying of the image. Another advantage is that nipped drive rollers after the dryer can be omitted to extend the time for the ink to be dry to the touch. Significantly increasing time to the first touch using nip-less rollers following drying also allows for lower temperatures to be used in the dryer. The exemplary nip-less drive roller 86 achieves the roll frictional force via electrostatics or varying electric fields that couple to the paper 14. The external forces can be controlled in geometry by electrode design. The magnitude of the force can be controlled by the electric field strength.

Figure 8:
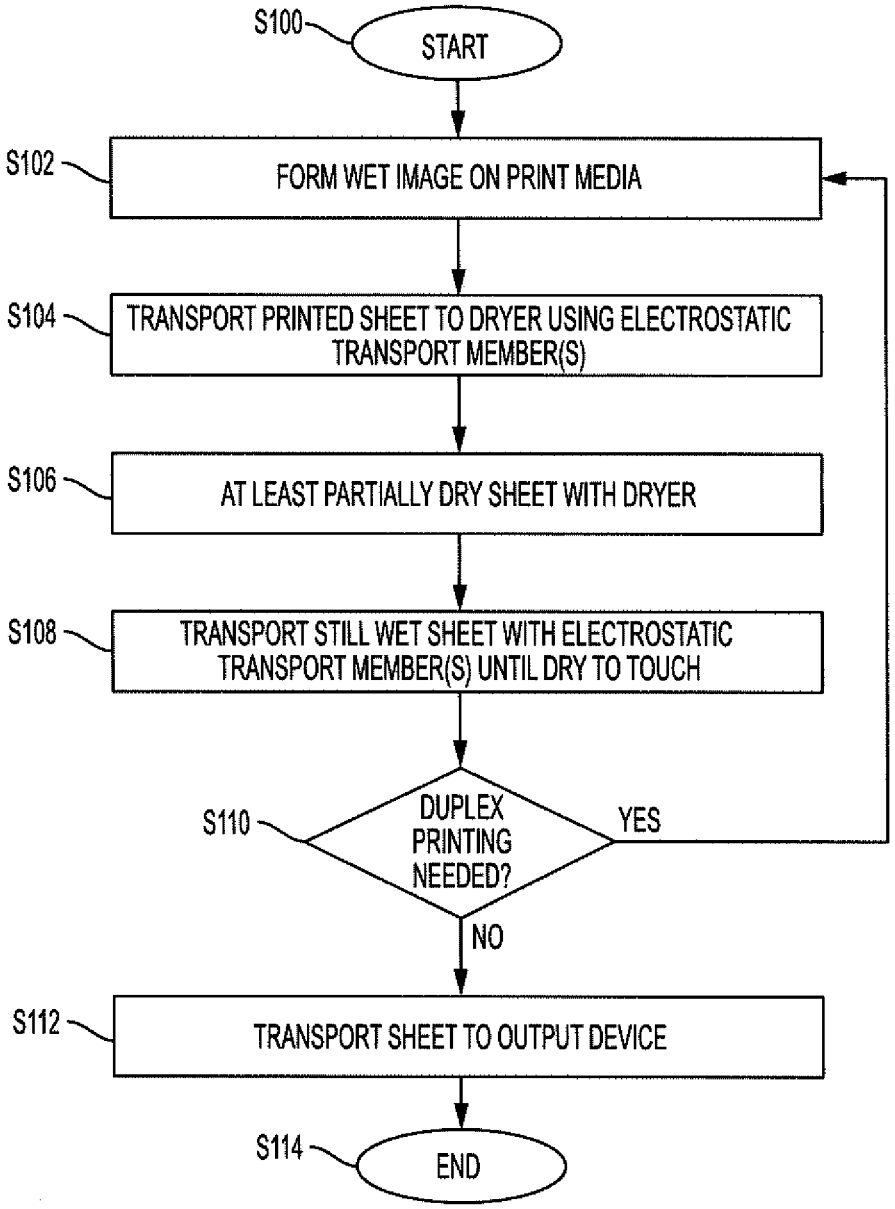
FIG. 8 is a flow chart illustrating a sheet drying method in accordance with another aspect of the exemplary embodiment.

FIG. 8 illustrates a printing method which can be performed with the apparatus of one or more of FIGS. 1-7. The method begins at S100.

At S102, a wet image 42 is formed on print media by applying droplets one or more inks to a sheet 14.

At S104, the sheet with the image thereon is transported by a sheet media transport mechanism 12 incorporating one or more transport members 18, 20, as described herein, to a dryer 52. Each transport member includes a drive roller which is rotated about an axis of rotation to advance the sheet in the downstream direction. In particular, the transport mechanism 12 conveys the printed media 44 in a downstream direction between the printhead assembly and the dryer without contacting the upper surface 50 of the print media or the wet image thereon.

At S106, the printed sheet 44 is dried with the dryer 52, where the wet ink is at least partially dried.

At S108, the sheet 14, with the at least partially dried image 42 thereon, is transported, by one or more transport members 22 of the sheet media transport mechanism 12, downstream from dryer 52, to a location where the wet ink becomes dry to touch. In particular, the transport mechanism 12 conveys the printed media in a downstream direction from the dryer without contacting the upper surface of the print media prior to the sheet being dry to the touch.

In some embodiments, at S110, the printed and dried sheet may be returned to the print engine along a return path 59 for printing on the opposite side of the sheet (S102).

At S112, the dry-to-touch printed sheet is transported, directly or indirectly, to a sheet output device 54. At this stage, conventional nip rollers may be used to convey the sheets.

The method ends at S114.

EXAMPLES

Figure 9:
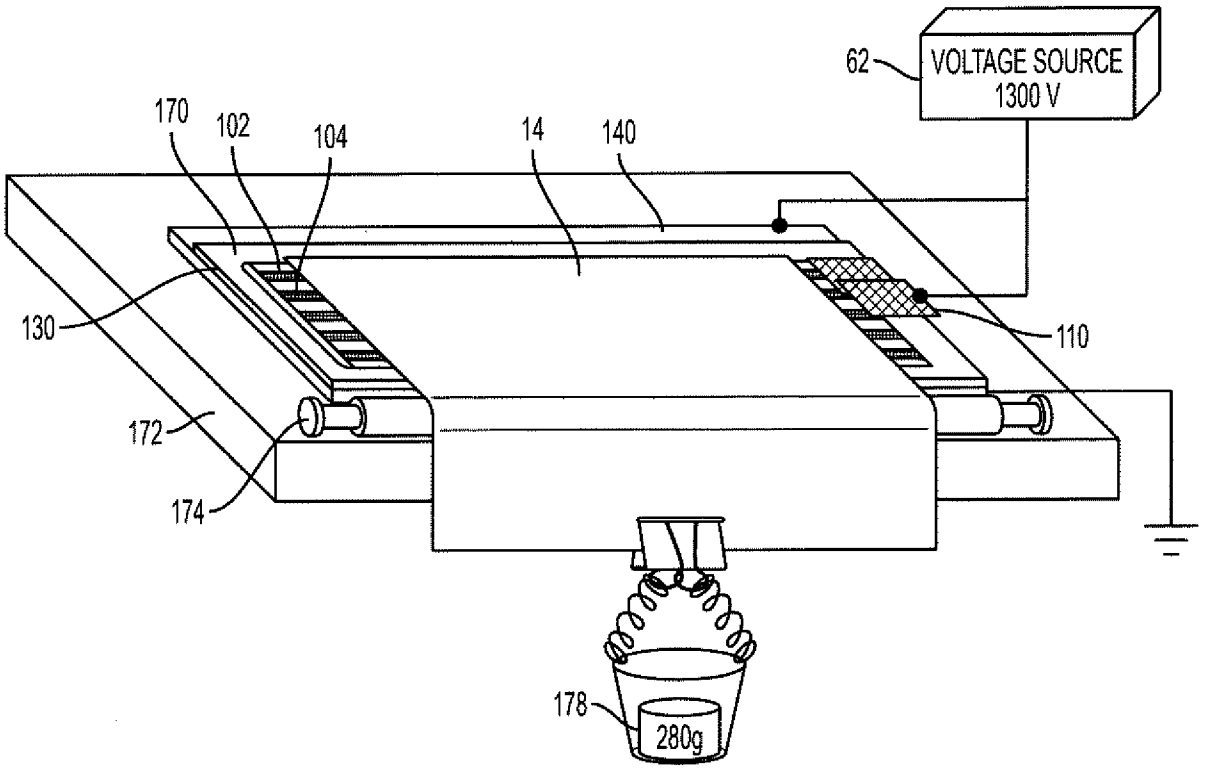
FIG. 9 illustrates an apparatus used for testing the forces generated between a roller and a sheet.

An apparatus is configured as shown in FIG. 9 for evaluating the friction force generated by an electric field on an 8.5×11 inch, 20 lb basis weight (75 gsm) sheet 14 (Xerox® Vitality™ Multipurpose Printer Paper). A test transport member 170 is prepared similar to that shown in FIG. 3 (not in roll form) including a set of parallel conductors 102, 104 embedded in an insulating sheet 130, grounded on its lower side by a ground plane 140. The test transport member 170 is supported by a platen 172, which carries a roller 174 that is free to rotate in front of the test transport member 170. A charging unit (voltage source 62) applies a direct voltage of 1300V to two of the conductors. To test the friction force generated, the sheet 14 is allowed to lie over the edge of the platen, supported by the roller 174. A weight is applied to the overhanging edge of the sheet (a weight 178 in a cup is held to the sheet by a clip). The applied voltage is able to keep the sheet from falling off the sheet when a weight of 280 g is used. The electric field is estimated to be 1300V/5 mm=0.26V/μm.

This suggests that the friction forces generated in the rollers 86 described herein will be sufficient for the roller to hold the sheet and advance it in the downstream direction without the need for a nip roller.

Figure 10:
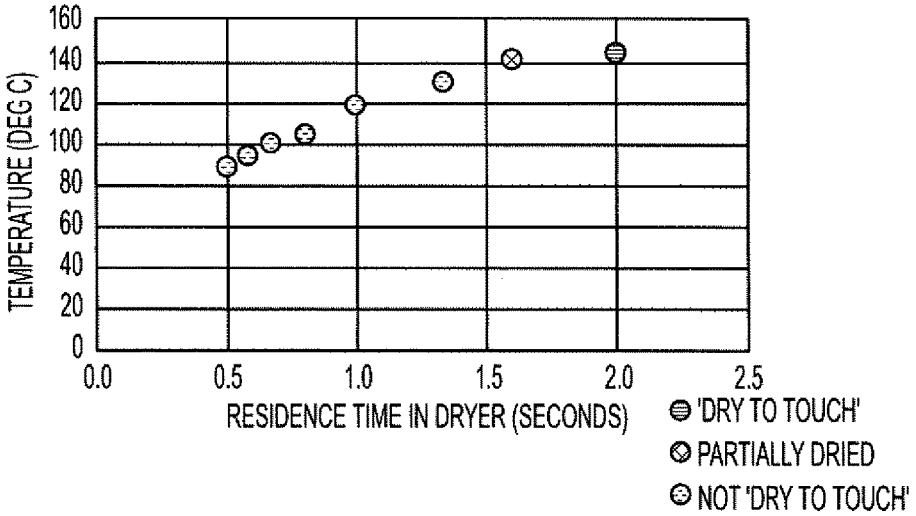
FIGS. 10 and 11 illustrate the time taken for an inkjet-printed sheet to reach a "dry to the touch" state at 145° C. and 105° C., respectively.
Figure 11:
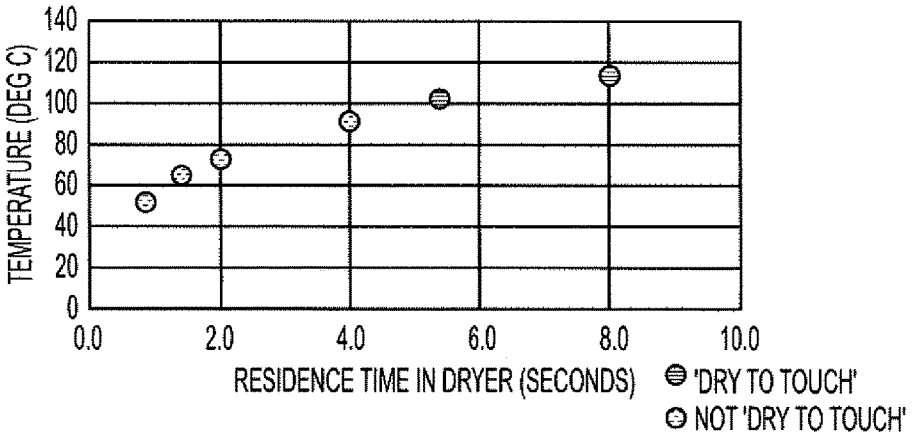

FIGS. 10 and 11 illustrate dryer residence times in an inkjet printer at different maximum temperatures for equivalent printed sheets. These FIGURES demonstrate that a sheet can be dried to touch at a lower temperature (105° C. in FIG. 11 vs 145° C. in FIG. 10), when a longer drying time is used (5 seconds vs 2 seconds). The longer drying time is feasible in the exemplary printer since the sheet is transported and supported only from the underside when the sheet is wet.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A printer comprising:

a printhead assembly which applies an ink composition to print media to form printed media;

a dryer, downstream of the printhead assembly, which at least partially dries the printed media;

a transport mechanism which conveys the printed media in a downstream direction between the printhead assembly and the dryer and between the dryer and an output device, the transport mechanism including at least one electric field-generating transport member, each of the at least one transport member including:

a drive roller which is rotated about an axis of rotation to advance the print media in the downstream direction, the drive roller including spaced electrical conductors, first portions of the electrical conductors being sequentially brought into proximity with the print media as the roller is rotated, and a commutator which sequentially contacts only a subset of the conductors that are in proximity with the print media; and a charging unit which applies a voltage to the commutator.

2. The printer of claim 1, wherein at least one of the least one transport members is downstream of the dryer.

3. The printer of claim 1, wherein at least one of the least one transport members is upstream of the dryer.

4. The printer of claim 1, wherein the conductors each include a second portion arcuately spaced from the first portion, wherein the first portion is located in a first region of the roller which is contacted by the print media in a force zone, and wherein the second portion is located in a second region of the roller which is spaced from the force zone, the commutator sequentially contacting the second portions of the conductors.

5. The printer of claim 1, wherein the first portions of the conductors extend parallel to the axis of rotation of the roller.

6. The printer of claim 1, wherein the drive roller includes an insulating layer and wherein the conductors are embedded in the insulating layer.

7. The printer of claim 6, wherein the insulating layer spaces the conductors from a ground plane, interior of the conductors.

8. The printer of claim 6, wherein the electrical conductors are interdigitated with grounded conductors, the grounded conductors being embedded in the insulating layer.

9. The printer of claim 1, wherein each roller includes at least 8 electrical conductors.

10. The printer of claim 1, wherein the at least one electric field-generating transport member comprises at least two electric field-generating transport members.

11. The printer of claim 10, wherein the at least two electric field-generating transport members are spaced by baffles.

12. The printer of claim 1, wherein the drive roller does not form a nip with another roller.

13. The printer of claim 1, wherein the transport mechanism conveys the printed media in a downstream direction between the printhead assembly and the dryer without contacting an upper surface of the print media.

* * * * *